US005888912A

United States Patent [19]

Piemonte

[11] Patent Number: 5,888,912

[45] Date of Patent: Mar. 30, 1999

[54] FABRIC FOR WIRE WOUND FLEXIBLE DUCTS

[75] Inventor: Vincent J. Piemonte, Salem, N.H.

[73] Assignee: Worthen Industries, Inc., Nashua, N.H.

[21] Appl. No.: 858,272

[22] Filed: May 19, 1997

[51] Int. Cl.[6] ..... D03D 3/00

[52] U.S. Cl. ..... 442/60; 442/104; 442/136; 442/186; 442/208; 428/343

[58] Field of Search ..... 442/60, 104, 136, 442/186, 208, 226; 428/343

[56] References Cited

U.S. PATENT DOCUMENTS 5,279,891 1/1994 Ward ..... 442/186

FOREIGN PATENT DOCUMENTS 2625205 12/1977 Germany .

*Primary Examiner*—Marion McCamish
*Assistant Examiner*—Elizabeth M. Cole
*Attorney, Agent, or Firm*—Samuels, Gauthier & Stevens

[57] ABSTRACT

A coated duct fabric for wire wound flexible ducts that is constructed from woven fabric having flat filament fill yarns and spun warp yarns woven in a 1/1 plain box weave.

6 Claims, 1 Drawing Sheet

FABRIC FOR WIRE WOUND FLEXIBLE DUCTS

FIELD OF THE INVENTION

Flexible ducts for venting confined working areas.

BACKGROUND AND BRIEF SUMMARY OF THE INVENTION

In flexible ducts, a coated fabric or film is secured to a helical wire. The coated fabric can be secured by adhesives, crimping or sewing. The ducts are typically used to exhaust gases and vapors from a confined working area, i.e. the holds of ships, below ground electrical conduits, etc. The ducts should be flexible, extendable, collapsible, gas impermeable, fire resistant, abrasion resistant, lightweight and have strength in the fill (longitudinal) direction of the duct.

The fabric customarily used for duct material is a woven or non-woven material which is saturated and/or coated. The fabrics that are particularly useful for this purpose are square woven, oxford or duck.

To achieve the aforementioned properties for a flexible duct, the primary emphasis has been on varying the coatings that are applied to the fabric; such as applying coatings on both sides, modifying the chemical/physical characteristics of the coatings, applying multiple coatings at differing viscosities, etc.

Of the aforementioned desirable properties, the present invention results in specific improvements in increasing the strength of the duct in the fill direction, reducing the weight of the duct and minimizing the pin holes (gas impermeable) in the duct material. The advantages are achieved by the use of a particular fabric weave.

Broadly, flat fill yarns are used in simple weaves with spun warp yarns. The flat fill yarns are much larger in denier than the warp yarns so fewer of them can be used yet strength is increased in the filled direction which is more critical and improves the finish duct durability. Although there are fewer larger denier yarns, because they lay flat they reduce the interstices in the fabric thereby both enabling less coating to cover more completely and reducing the number of pin holes. Further, the fill yarns are less expensive to process so the fabric cost is also reduced.

In a preferred embodiment of the invention, a duct fabric comprises a woven fabric having flat filament fill yarns and spun warp yarns woven in a 1/1 plain box weave.

DESCRIPTION OF THE PREFERRED EMBODIMENT(s)

Figure 1:
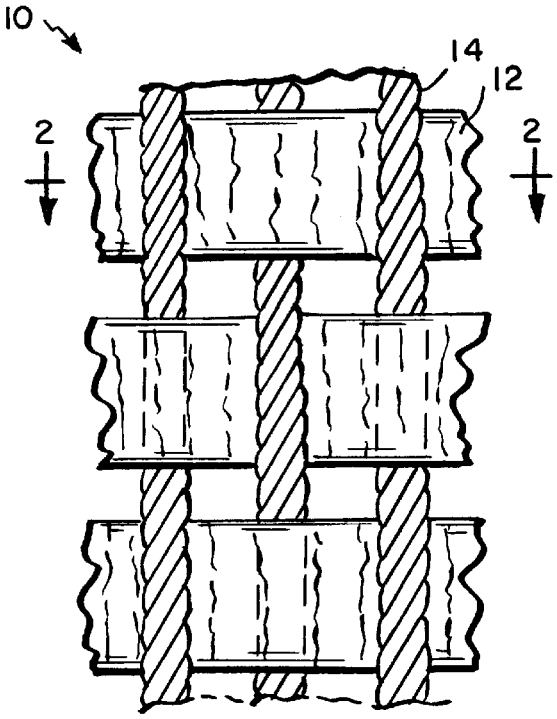
FIG. 1 is a plan fragmentary view of a fabric embodying the invention.
Figure 2:
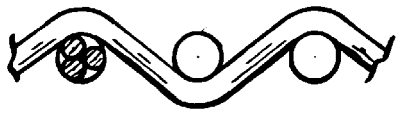
FIG. 2 is a sectional view of FIG. 1 taken along lines 2—2 of FIG. 1.

Referring to FIGS. 1 and 2, a fabric embodying the invention is shown generally at 10 and comprises flat filament fill yarns 12 woven with spun warp yarns 14 to form an uncoated fabric. The fabric shown in FIGS. 1 and 2 comprises a standard box one over one weave.

Figure 3:
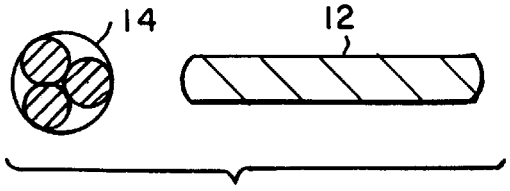
FIG. 3 is an illustration of the yarns used in the woven fabric of the invention.

Referring to FIG. 3, the warp yarns 14 are in the range of between 16 to 20d, e.g. 18 denier while the fill yarns 12 can be either 300 denier or two-ply filament yarns of between 600 to 800d, e.g. 600 denier (texturized). The spun yarns 14 give better abrasion while the filament yarns 12 provide more strength and less coating is required to fill voids.

Figure 4:
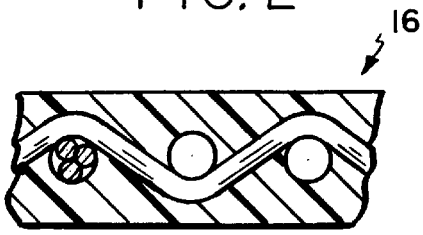
FIG. 4 is a sectional view of a coated fabric of the invention.

The fabric of FIG. 1 is coated as shown in FIG. 4, such as with a latex neoprene compound. The coating of fabric for flexible ducts is well known in the art.

Figure 5:
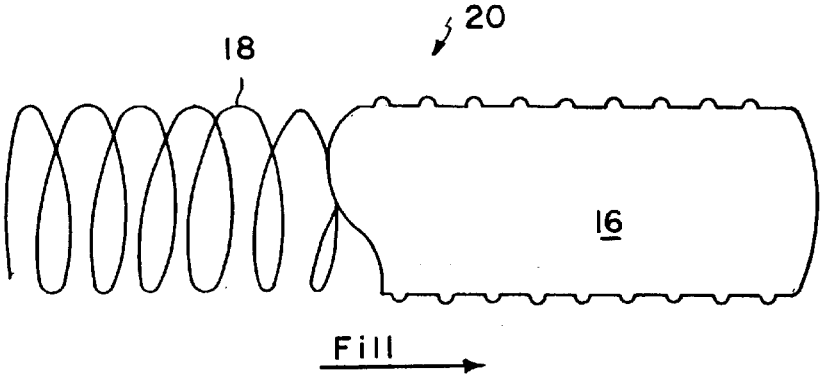
FIG. 5 is an illustration of a hose duct with the coated fabric of the invention.

Referring to FIG. 5, the coated fabric 16 is secured to a flexible spiral wire 18 to form a flexible duct 20. The fill direction is shown by the arrow.

The preferred embodiment has been described with reference to a one to one plain box weave, tabby or taffeta with one warp over and one warp under the filling throughout the fabric construction. Other weaves suitable for purposes of the invention could include 1/2, 2/1, 1/3, 3/1.

A standard duct fabric in the industry is fabric N561 sold for many years by the Nylco Division of Worthen Industries, Inc., Nashua, N.H.

A coated hose fabric embodying the invention was fabricated and compared to the Nylco N561 fabric to demonstrate the improved properties of the coated hose fabric of the invention.

In the fabric of the invention, Fabric A, polyester spun yarn twisted 18d singles was woven with flat filament fill yarns 300d in a standard 1/1 box weave construction warp yarns 32×26±two picks. The weight of the woven fabric was 4.5 oz/yd$^2$. The fabric of FIG. 1 was knife over roll coated on both sides with a latex neoprene compound, specifically commercially available Upaco WN378, Upaco Adhesives Division of Worthen Industries, Inc., Nashua, N.H. The finish coated weight of the fabric was 9.0 to 10.0 oz/yd$^2$.

Fabric A was compared to a coated prior art fabric.

The fabric characteristics prior art fabric were box weave polyester warp yarns 18d fill yarns 18d. The prior art fabric was coated on both sides with the Upaco 5955. The total coating weight was 10.5–12.0.

EXAMPLE

Fabrics constructed and coated as set forth above were tested as follows. In order for the fabric to be acceptable for its intended use it must meet certain standards. The prior art fabric met those standards. The fabric of the invention exceeded those standards.

| | Fabric A | N561 |
|---|---|---|
| ASTM D-751 Grab tensile strength | | |
| warp | 180 lbs/in | 180 lbs/in |
| fill | 260 lbs/in | 208 lbs/in |
| Coating weight | 5.25 ± 0.25 oz/yd$^2$ | 6.38 ± 0.25 oz/yd$^2$ |
| ASTM D-737 | Air permeability reduced by 20% | |

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A coated duct fabric comprising:

a woven fabric having flat filament yarns in the fill direction and spun filament yarns in the warp direction, the fabric coated with a latex based compound wherein the denier of the spun warp filament yarns is between about 16 to 20d and the denier of the flat filament yarns is between about 600 to 800d.

2. The fabric of claim 1 wherein the weave is a 1/1 box weave.

3. The fabric of claim 1 wherein the warp to fill filaments are approximately 32×26.

4. The fabric of claim 1 wherein the fabric is coated on both sides with the latex based compound.

5. The fabric of claims 1, 2, 3, or 4 wherein the finished coated weight of the fabric is between about 9.0 to 10.0 $oz/yd^2$.

6. The fabric of claim 5 wherein the fabric has a grab tensile strength of at least 260 lbs/in.

* * * * *